US007673427B2

(12) United States Patent
Morey

(10) Patent No.: US 7,673,427 B2
(45) Date of Patent: Mar. 9, 2010

(54) CLAMP FOR USE WITH METAL BAR JOISTS AND BEAMS

(76) Inventor: Douglas H. Morey, 215 Woodstock, Clarendon Hills, IL (US) 60514

( * ) Notice: Subject to any disclaimer, the term of this patent is extended or adjusted under 35 U.S.C. 154(b) by 816 days.

(21) Appl. No.: 11/419,428

(22) Filed: May 19, 2006

(65) Prior Publication Data

US 2007/0266674 A1 Nov. 22, 2007

(51) Int. Cl.
*E04C 2/52* (2006.01)

(52) U.S. Cl. ..... 52/220.8; 52/219; 248/228.1; 24/458

(58) Field of Classification Search ..... 52/220.8, 52/218, 219; 248/228.1, 228.5, 231.6; 24/457, 24/458, 569
See application file for complete search history.

(56) References Cited

U.S. PATENT DOCUMENTS

| | | | | | |
|---|---|---|---|---|---|
| 2,276,139 | A | | 3/1942 | Anderson et al. | 98/114 |
| 2,717,562 | A | | 9/1955 | Ewing | |
| 2,838,832 | A | * | 6/1958 | Potter Janes W | 29/428 |
| 2,990,920 | A | | 7/1961 | Hoffman, Jr. | 29/428 |
| 2,994,415 | A | | 8/1961 | Halle | 189/36 |
| 3,392,499 | A | | 7/1968 | McManus | 52/483 |
| 3,527,007 | A | | 9/1970 | McManus | 52/327 |
| 3,642,150 | A | | 2/1972 | Zizak | |
| 3,964,218 | A | | 6/1976 | Ho | 52/90 |
| 4,472,917 | A | * | 9/1984 | Alderton et al. | 52/489.1 |
| 4,620,397 | A | | 11/1986 | Simpson et al. | 52/66 |
| 4,660,799 | A | | 4/1987 | Butland | 248/676 |
| 4,685,646 | A | | 8/1987 | Harrison | |
| 5,259,165 | A | * | 11/1993 | Koyama | 52/506.06 |
| 5,292,096 | A | * | 3/1994 | Bodenheimer | 248/228.5 |
| 5,335,469 | A | | 8/1994 | Stuart | 52/655.1 |
| 5,511,354 | A | | 4/1996 | Eidson | 52/544 |

(Continued)

OTHER PUBLICATIONS

International Search Report for International Application No. PCT/US2007/068732, dated Dec. 17, 2007.

(Continued)

*Primary Examiner*—Jeanette E Chapman
*Assistant Examiner*—Daniel Kenny
(74) *Attorney, Agent, or Firm*—Marshall, Gerstein & Borun LLP

(57) ABSTRACT

A clamp for use with metal bar joists (or beams) has one or more steel angled bracket members or plates, adapted to fit under the corrugations of a corrugated steel roof. Each plate of the clamp is adapted to sit horizontally across a top of the bar joist perpendicular to the joist, and extend slightly over an edge of the joist. Each plate contains an elongate slot allowing a bolt to be inserted through the slot. A retainer heel clip is secured to an end of each such bolt. This retainer heel clip is tightened to the underside of the top flange of the bar joist using a washer and a threaded plate or nut, thus providing a clamping action. Each clamp has a vertical attachment tongue section of steel welded to it, including one or more elongate slots which complement perforations that occur along the length of a steel framing angle, allowing bolts to attach the clamp and the framing angle together. A pair of the clamps may be used to secure a pair of support angles for supporting a rod for hanging objects at desired locations within a roof support structure.

27 Claims, 11 Drawing Sheets

U.S. PATENT DOCUMENTS

| | | | | | |
|---|---|---|---|---|---|
| 5,516,068 | A | | 5/1996 | Rice | 248/300 |
| 5,560,576 | A | * | 10/1996 | Cargill | 248/231.61 |
| 5,577,353 | A | | 11/1996 | Simpson | 52/92.2 |
| 5,647,175 | A | | 7/1997 | Smyth | 52/58 |
| 5,743,063 | A | | 4/1998 | Boozer | 52/713 |
| 5,857,292 | A | | 1/1999 | Simpson | 52/22 |
| 5,964,042 | A | * | 10/1999 | Carper | 33/407 |
| 6,098,942 | A | | 8/2000 | Heath | |
| 6,240,682 | B1 | | 6/2001 | James et al. | 52/90.2 |
| 6,341,466 | B1 | | 1/2002 | Kehoe et al. | 52/712 |
| 6,470,644 | B2 | | 10/2002 | James et al. | 52/745.06 |
| 6,471,171 | B1 | | 10/2002 | VanderVelde | |
| 6,729,083 | B1 | | 5/2004 | Soyko | 52/220.8 |
| 6,837,019 | B2 | | 1/2005 | Collie | 52/712 |

OTHER PUBLICATIONS

Written Opinion for International Application No. PCT/US2007/068732, dated Dec. 17, 2007.

Jaco Art L.L.C., Adjustable Roof Frame (understood to be on sale or in public use at least as early as May 18, 2005), www.roofframes.com.

* cited by examiner

FIG. 4
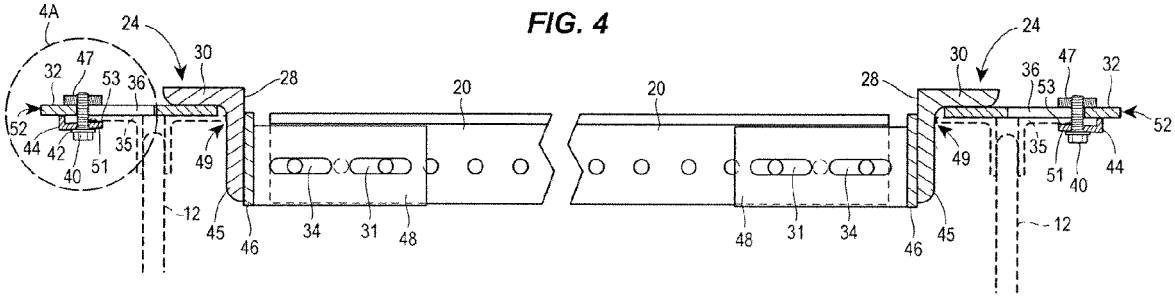
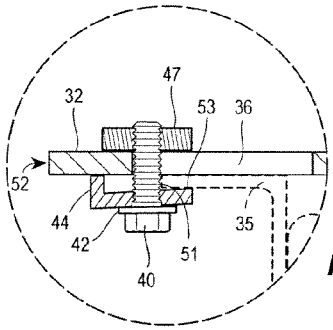
FIG. 4A

CLAMP FOR USE WITH METAL BAR JOISTS AND BEAMS

FIELD OF THE DISCLOSURE

This disclosure relates to a clamp for use with metal bar joists and beams in order to secure cross members to the bar joists.

BACKGROUND OF THE DISCLOSURE

In building construction, and in steel-framed building construction in particular, metal bar joists are used as roof framing, typically under corrugated roof decking. The metal bar joists are also used to hang such items as lighting fixtures, sprinkler header assemblies, product conveyors, HVAC equipment, drywall for ceilings, and the like. For large equipment components, such as some air conditioning units, it is necessary to cut through sections of the corrugated roof decking to form an opening sized to receive the large equipment. Openings are also formed by cutting through sections of roof decking for other purposes, such as to create roof access openings.

In order to reinforce the weakened roof decking above the bar joist structure once such openings are formed, the typical practice is to weld angle clips to bar joists at panel points to support welded angle framing steel. Panel points are locations just above the apex of two structural members that depend downwardly, at angles, from the metal bar joists. These zigzagging diagonal members form a truss support structure.

Equipment may be set on a roof deck having greater weight than the decking can support, but within the capacity of the roof joist structure. There is a need to reliably transfer such loads from the decking to the joists.

The conventional practice of welding clips to support welded angle framing steel has several drawbacks. For instance, the welding may cause unintended structural damage to the remaining length of the bar joists; the welding may have to be performed from awkward angles, with limited space constraints, making the welding difficult; and the welding must be performed by skilled certified welders.

Another common way to install pieces of framing angle between bar joists is to cut out a section from each end of a 90°-shaped piece of metal, so that one flat surface remains on each end. This flat surface then rests on top of each parallel running bar joist, with the cut surface extending downward, to be used for mounting equipment. However, such a support angle would need to be installed before the decking. There can also be other problems associated with this arrangement. For example, any time material is removed from a structural component, such as a framing angle, it will then become weakened and will be less capable of supporting loads. Also, stress will tend to be concentrated along the line where the edge of the top flange of the metal bar joist meets the non-cut side of the framing angle. As a direct result of this non-uniform, poorly-distributed load, the top flange of the metal bar joist can end up bending, and this can lead to roof failure.

As demonstrated in the following sections, a steel clamp is disclosed that can be bolted in place at strategic locations along bar joists, under the corrugated roof decking, as a more reliable solution to reinforcing roofing structure in the vicinity of openings formed in roof decking. The solution is also useful to reinforce bar joists in roofing structures where no openings are formed. For example, clamps of the present disclosure may be employed where structural reinforcement is necessary in order to support extreme loads above or below particular locations in the roof, such as for heavy air conditioning condenser units.

SUMMARY OF THE DISCLOSURE

A clamp which attaches to a metal bar joist or beam on one side and to a cross member on a reverse side is disclosed. This cross member spans the distance between two bar joists or beams and has a corresponding clamp affixed to another end of the cross member to facilitate attachment to the next bar joist or beam. For the sake of brevity, it will be understood that subsequent uses of the term "bar joist" or "joist" in this disclosure likewise refer to beams. The clamp has at least one flat length of steel or plate, made of a suitable material, such as standard A36 steel. Each plate fits under the corrugations of a typical corrugated steel roof. Each plate of the clamp is adapted to ride horizontally across a top of the bar joist, perpendicularly to the bar joist, and extend slightly over the edge of the joist. Each plate is provided with at least one elongate slot which allows a bolt with a washer attached to be inserted through the slot. A retainer heel clip may be placed onto the end of each bolt. This retainer heel clip may be tightened onto the underside of the top flange of the bar joist using a washer and nut, or a threaded block, thus providing the clamping action of the present disclosure. Each clamp may have a vertical attachment tongue section of steel welded to it. This vertical attachment tongue section contains at least one, but preferably two, or more, elongate slots which complement perforations that occur along the length of steel framing angle, allowing bolts to attach the clamp and the framing angle together. Typically a steel framing angle is used to span the distance between two bar joists, and a clamp will be attached to the framing angle at each end. Each clamp will then be attached to each bar joist. Each completed unit can then be used as part of a structure to reinforce an opening in a corrugated steel roof or to support a piece of equipment above or below the roof.

BRIEF DESCRIPTION OF THE DRAWINGS

FIG. 4 is a cross-sectional view of two clamps of the first embodiment of the present disclosure, each connected to opposite ends of an L-shaped steel framing angle which spans the distance between two bar joists acting as a cross member support;

FIG. 4A is an enlarged cross-sectional detail view, of the region within dashed circle 4A of FIG. 4;

DETAILED DESCRIPTION OF THE DISCLOSURE

Figure 1:
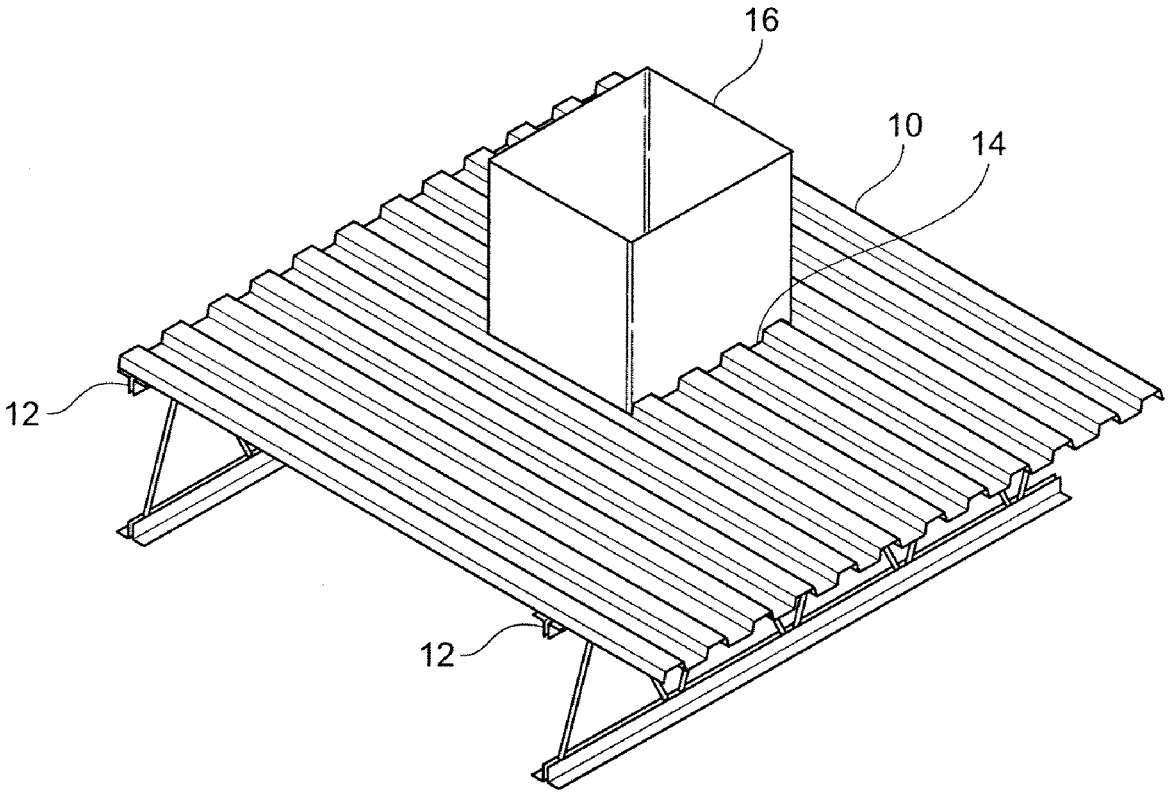
FIG. 1 is a perspective view of a section of corrugated steel roof, supported by rows of structural truss-forming members, and showing structure protruding through an access hole in the roof.

Having reference to the drawings, where like reference numbers comprise like elements, there is shown in FIG. 1 a section of a steel corrugated roof material, generally denoted by reference number 10. This roof section 10 is supported by at least two parallel metal bar joists 12. The roof section 10 rests upon these joists such that downwardly-open channels formed by corrugations of the roof material run in a direction perpendicular to the bar joists 12. An access hole 14 is shown in this roof section 10 and a structure 16 protrudes through the access hole 14.

Figure 2:
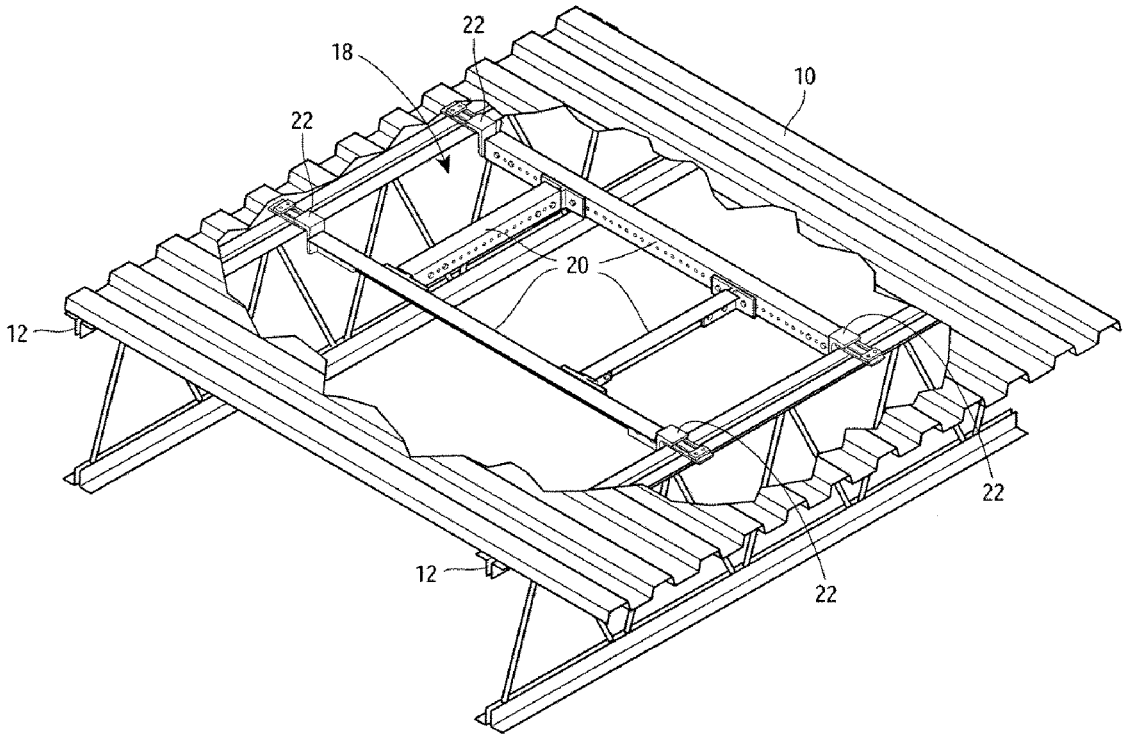
FIG. 2 is a perspective view, partially cut away, of a section of corrugated steel roof material under which a frame containing clamps which attach to metal bar joists supporting the section of roof material is provided.

FIG. 2 shows a perspective view, partially cut away underneath the steel corrugated roof section 10. As shown in FIG. 2, a metal frame 18, typically comprised of steel framing angle 20, may be used to span the distance between two bar joists 12 and a clamp 22 is attached to the framing angle 20 at each end. Each clamp 22 is then attached to a respective bar joist 12. Other pieces of framing angle 20 are then used to join these cross member pieces perpendicularly to the span between the bar joists.

The frame 18 is used to support the corrugated roof section 10, when there is a structure 16 as shown in FIG. 1 protruding through an opening in the roof section 10. Alternately, there may be no opening provided in a given roof section 10, but rather, a need to accommodate installation of equipment requiring extra support above or below the roof section 10.

Figure 3A:
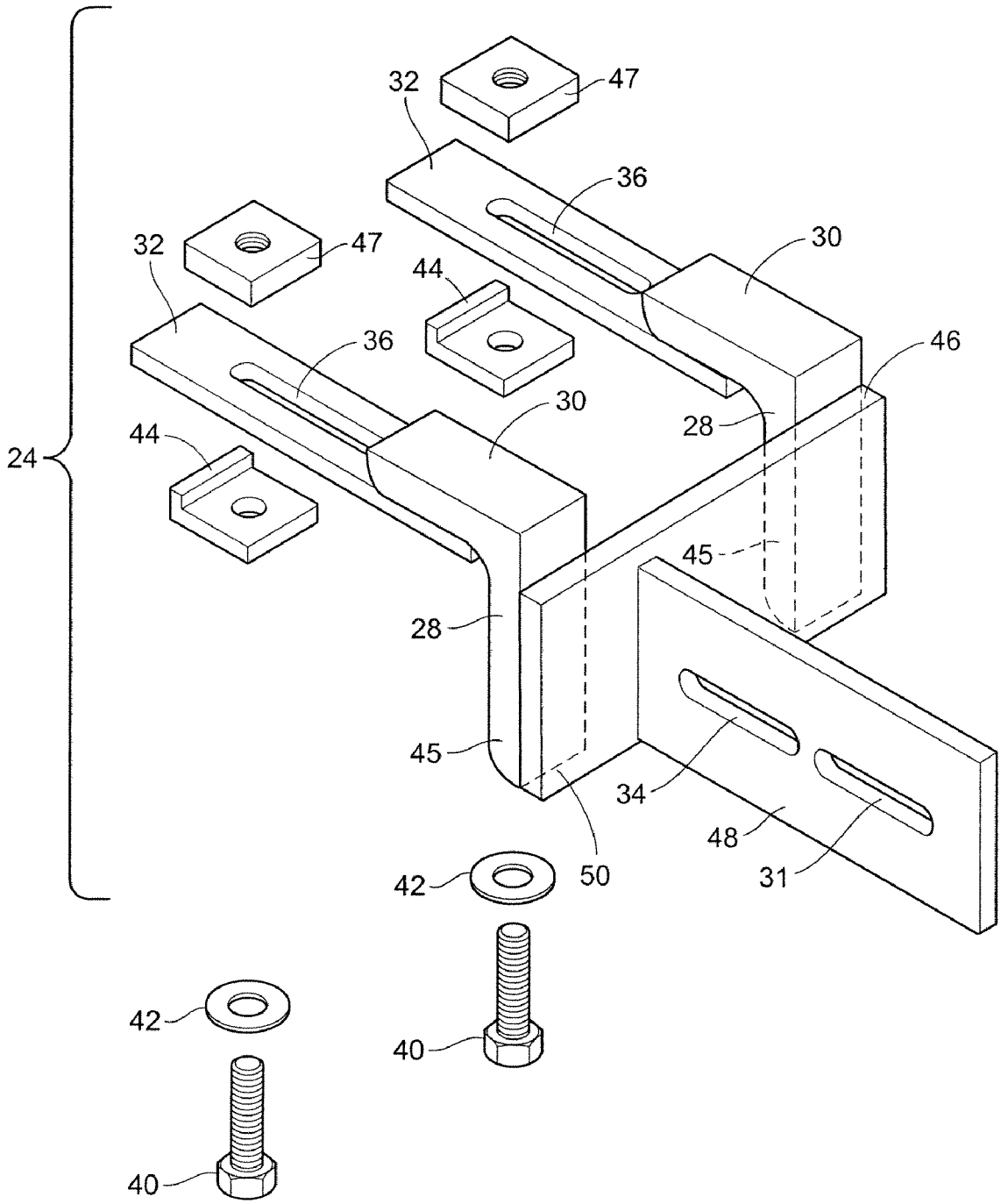
FIG. 3A is an exploded view of a clamp of a first embodiment of the present disclosure, each clamp plate having an elongate slot.
Figure 3B:
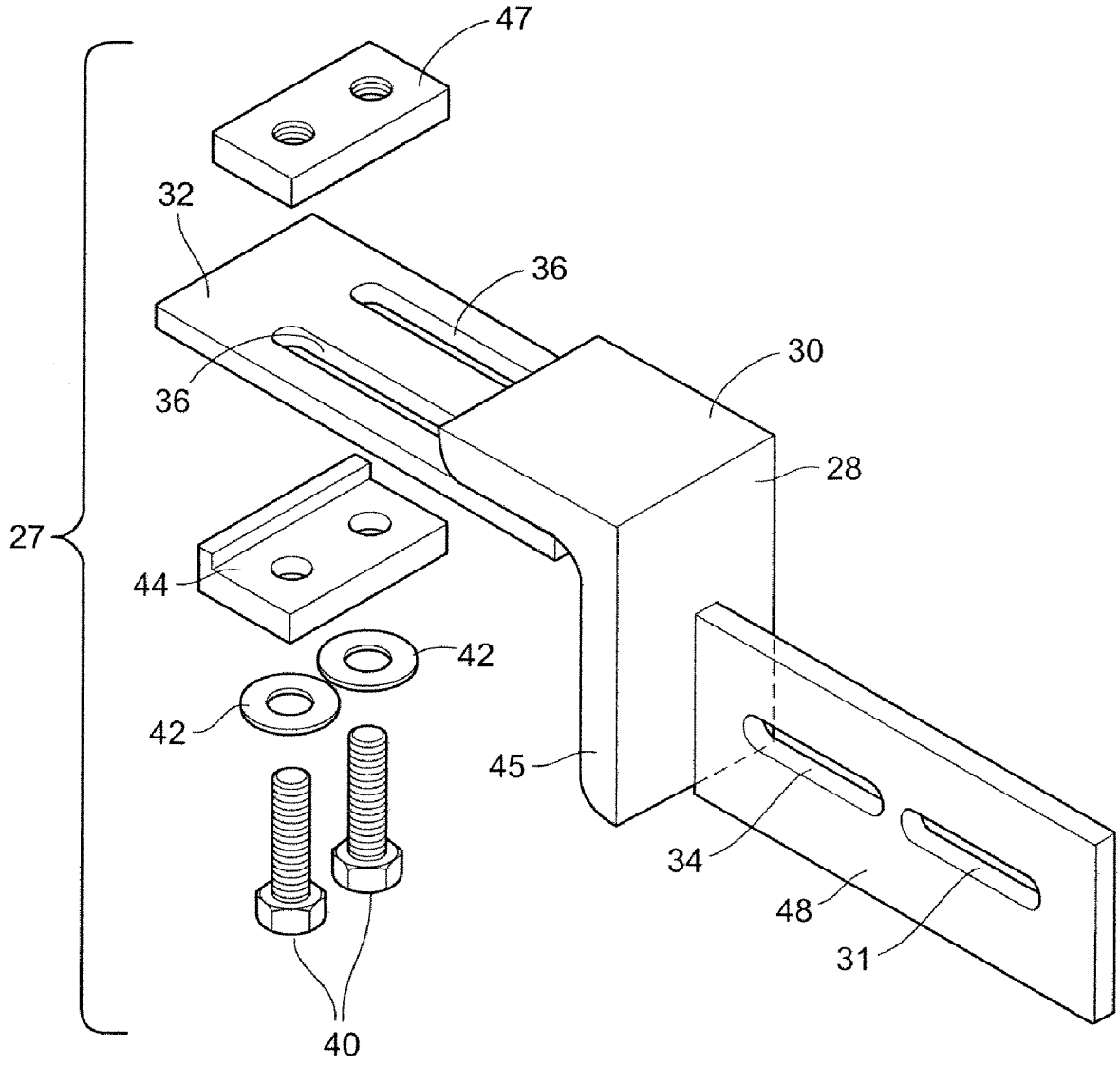
FIG. 3B is an exploded view of a clamp of a second embodiment of the disclosure.
Figure 3C:
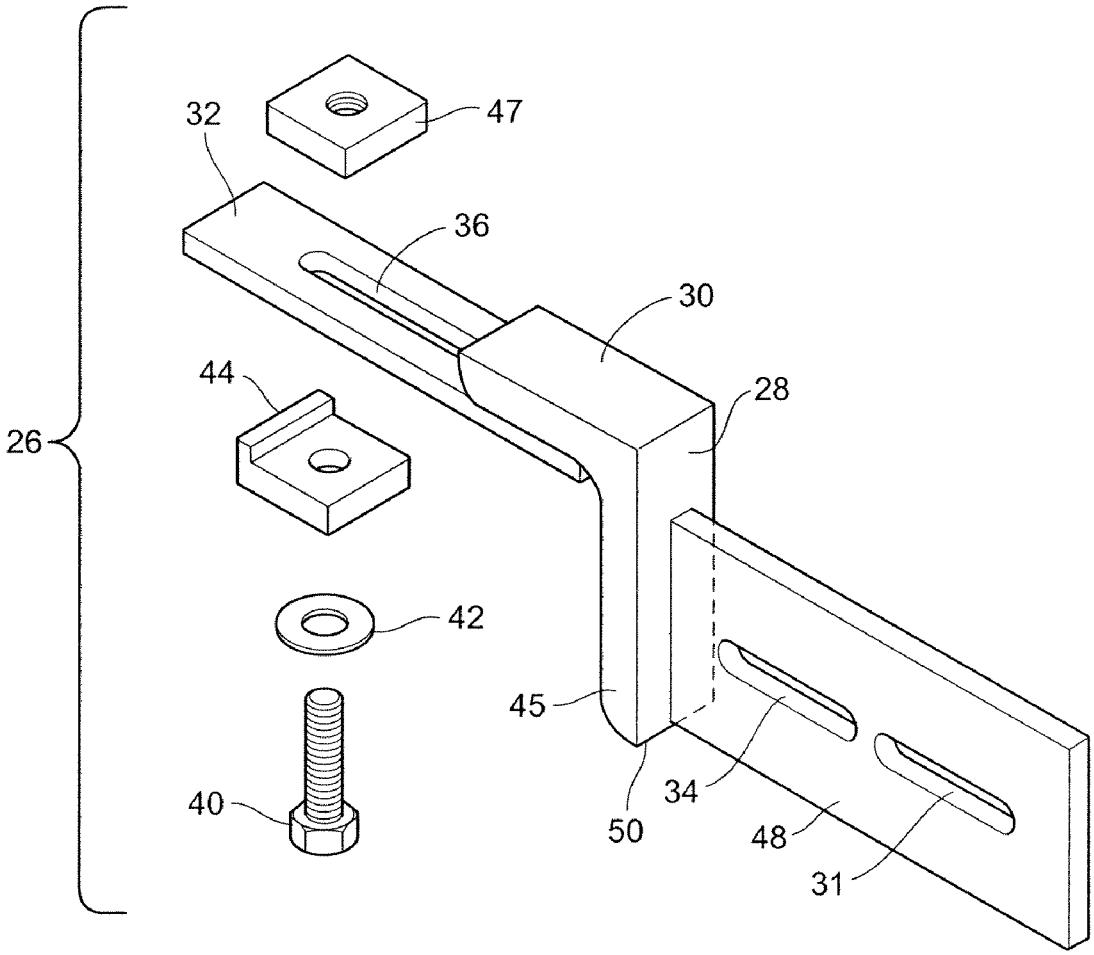
FIG. 3C is an exploded view of a third embodiment of the present disclosure.

FIGS. 3A, 3B, and 3C show exploded views of various embodiments of the clamps 24, 26, 27 disclosed herein for metal bar joists 12. There is much commonality among the parts of the clamps 24, 26, 27. Each of the clamps 24, 26, 27 has at least one steel angled bracket members 28, made of standard A36 steel, each of which has a horizontal component 30 that fits into an open end of a steel roof corrugation 41. Welded (or otherwise permanently affixed) onto each horizontal component 30 is a clamp plate 32, which is used to attach the clamp 24, 26, 27 to the top flange 35 of the bar joist 12. Each clamp plate 32 rests across an upper surface of the top flange 35 of the bar joist 12 and extends slightly over a lateral edge of the bar joist 12. Each clamp plate 32 has a first end and a second end, and includes at least one aperture, which may be in the form of an elongate slot 36. A bolt 40, preferably with a washer 42 attached, may be inserted through the slot 36. A retainer heel clip 44, having a bolt-receiving aperture therethrough, which aperture is alignable with the elongate slot 36 of the clamp plate 32, receives bolt 40 through the bolt-receiving aperture.

The retainer heel clip 44 is tightened against an underside of the top flange 35 of the bar joist 12, opposite the clamp plate 32, using a washer 42 and a threaded plate 47, thereby providing a clamping action. Thus, the retainer heel clip 44 and clamp plate 32 act as a jaw and mandible of the clamp. By providing a threaded plate 47 above the clamp plate 32, it is possible to tighten the bolt 40 without the need to secure a nut in a location with potentially limited access, such as within a corrugation of steel roof material. However, it is recognized that a nut (not shown) may also be used for securement of the bolt 40.

Figure 3D:
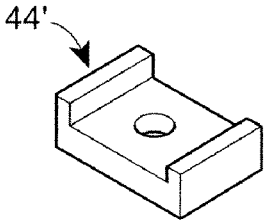
FIG. 3D is a perspective view of an alternate retainer heel clip for use with any of the clamps disclosed herein, to accommodate a lipped flange of a bar joist such as that shown in phantom lines in FIG. 3E.
Figure 3E:
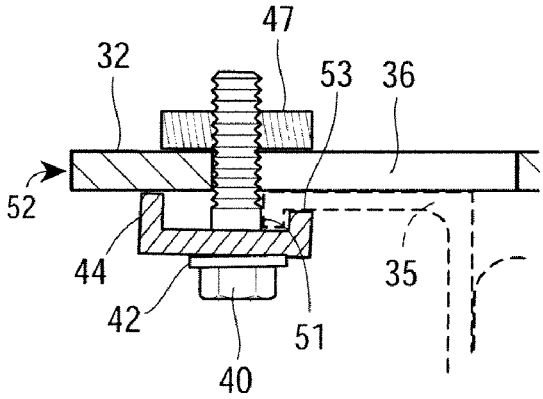
FIG. 3E is a cross-section view of a clamp of the present disclosure in combination with a retainer of the type shown in FIG. 3D, with a bar joist having a lipped flange shown in phantom lines.

As indicated in FIGS. 3D and 3E, there may be a need for a retainer heel clip 44' which can accommodate a bar joist having a lipped flange. The retainer heel clip 44' has a ridge to complement such a lipped flange, so the retainer heel clip 44', when tightened using a bolt 40 and a threaded plate 47, secures the clamp to the top flange 35 of the bar joist.

Clamp 24 has a clamp backing plate 46 welded (or otherwise permanently affixed) to the vertical components 45 of the angled bracket members 28. A vertical attachment tongue 48 may be welded (or otherwise permanently affixed) to a rear surface 50 of the clamp backing plate 46. The vertical attachment tongue 48 may be made of steel or other suitable material.

Clamps 26,27 each has a similar vertical attachment tongue 48 welded (or otherwise permanently affixed) perpendicularly to the rear surface 50 of the vertical component 45 and therefore does not require a clamp backing plate 46 like the clamps 24. Each vertical attachment tongue 48 contains at least one, but preferably two, or more, tongue apertures, such as elongate slots 31,34, which align with a plurality of perforations along a length of steel framing angle 20 to be secured to the clamp 24, 26, 27, and allow bolts 40 to secure the clamp 24, 26, 27 and the framing angle 20 together (See FIG. 4), thus creating a cross member support. A central axis of each elongate slot 31, 34 through the vertical attachment tongue 48 is perpendicular to a central axis of the elongate slots 36 of the clamp plate 32.

FIG. 4 shows a cross-sectional view of clamp 24, along with a broken away view of framing angle 20, connecting the two clamps 24. Each plate 32 of the clamp 24 is positioned on top of the metal bar joist top flange 35, with the vertical component 45 of the angled bracket member 28 in contact with an inner edge 49 of the top flange 35 of the metal bar joist 12. The first end 52 of the clamp plate 32 extends over the outer edge 51 of the top flange 35 of the metal bar joist 12. The elongate slot 36 extends over the outer edge 51 of the top flange 35 of the metal bar joist as well. This allows each fastening bolt 40 and washer 42 to be inserted through the open elongate slot 36, wherein a retainer heel clip 44 is brought upward from underneath a lower surface 53 of the top flange 35 of the metal bar joist 12. As best shown in FIG. 4A, this retainer heel clip 44 is tightened against the lower surface 53 of the top flange 35 of the metal bar joist 12 using a threaded plate 47 and a washer 42. FIG. 4 also shows that the backing plate 46 of clamp 24 has a steel vertical attachment tongue 48 welded or otherwise permanently secured to it.

This vertical attachment tongue 48 contains two apertures, such as elongate slots 31, 34 which align with two of the plurality of perforations along each length of steel framing angle 20 and permit bolts to attach the clamp 24 and the framing angle 20 together. The steel framing angle 20 is shown broken away, inasmuch as the framing angle 20 may be most any length necessary to span the distance between the metal bar joists 12.

Figure 4B:
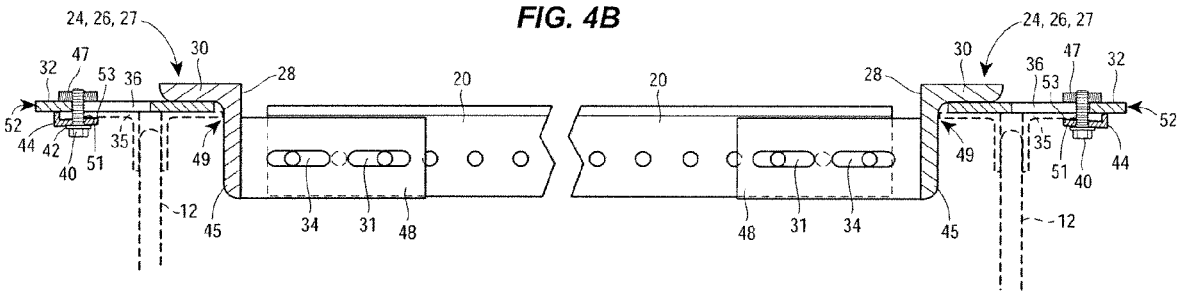
FIG. 4B is a cross-sectional view of two clamps of the second or third embodiments of the present disclosure, each connected to opposite ends of an L-shaped steel framing angle which spans the distance between two bar joists acting as a cross member support.

FIG. 4B is similar to FIG. 4, but shows a cross-sectional view of the other clamp embodiments, i.e. clamp 26 or 27, in which there is no clamp backing plate 46.

Figure 5A:
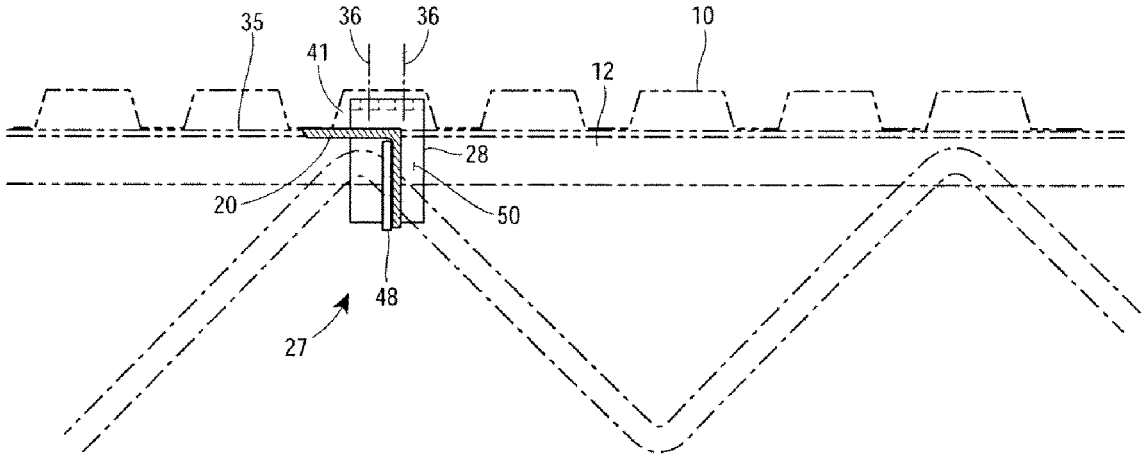
FIG. 5A is a side view of a clamp of the second embodiment of the present disclosure, as installed on top of the top flange of a metal bar joist, and under a corrugation of a corrugated steel roof.

FIG. 5A shows a side view of clamp 27, which is provided with two elongate slots 36. The clamp 27 is illustrated as installed on top of the top flange 35 of a metal bar joist 12, under a corrugation 41 in a corrugated steel roof section 10. This view shows the rear surface 50 of the angled bracket member 28, with the vertical attachment tongue 48 of the clamp 27 directed out of the page. Attached to this vertical attachment tongue 48 is a section of framing angle 20. The centerlines of the elongate slots 36 are indicated as well. A clamp 26 having one plate and one elongate slot 36, such as that shown in FIG. 3C, may be installed under one corrugation in a similar manner.

Figure 5B:
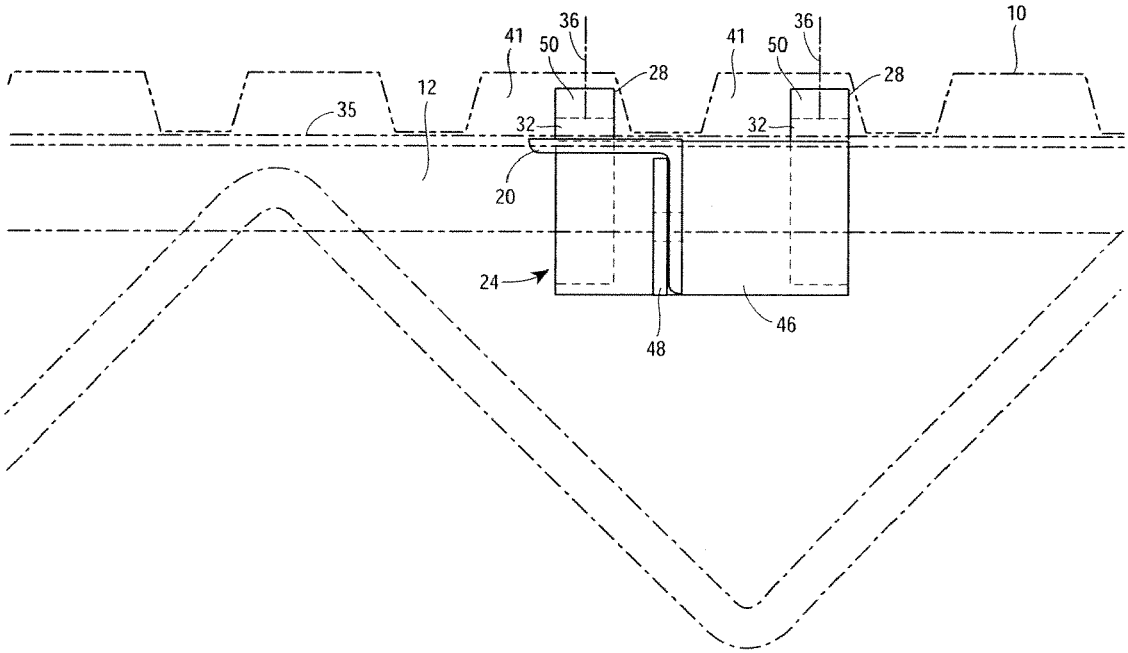
FIG. 5B is a side view of the clamp of the first embodiment of the present disclosure, as installed on top of the top flange of a metal bar joist, and under two corrugations of a corrugated steel roof.

FIG. 5B shows a side view of a clamp 24 of FIG. 3A with two clamp plates 32, each containing one elongate slot 36. The two clamp plates 32 allow installation of the clamp 24 from opposite sides of the same bar joist, with an aligned vertical attachment tongue 48 in between the two clamps 32. As indicated above, each of the clamp plates 32 has a bracket member 28, having a horizontal component 30 and a vertical component 45 (as seen in FIG. 4A). The clamp 24 is illustrated as installed on top of the top flange 35 of a metal bar joist 12, under two corrugations 41 in a corrugated steel roof section 10. This view shows a rear surface 50 of each angled bracket member 28 rising above the clamp backing plate 46 to which they are welded, along with a vertical attachment tongue 48 of the clamp 24 directed out of the page. Attached to this vertical attachment tongue 48 is a section of framing angle 20.

Figure 6A:
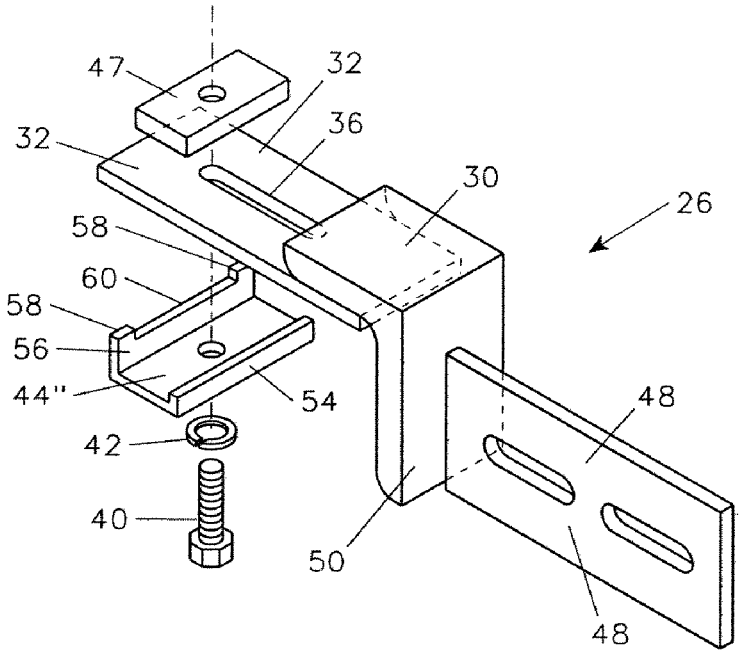
FIG. 6A is a perspective, exploded view of the clamp of the third embodiment in combination with another alternate retainer heel clip.
Figure 6B:
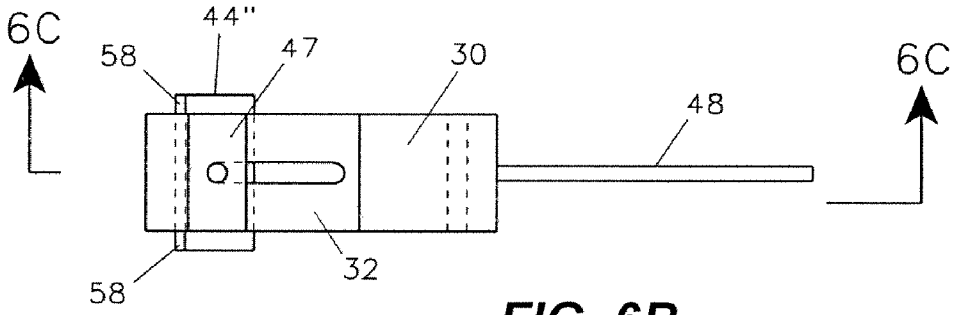
FIG. 6B is a top plan view of the combination of the clamp of the third embodiment and the alternate retainer heel clip of FIG. 6A.
Figure 6C:
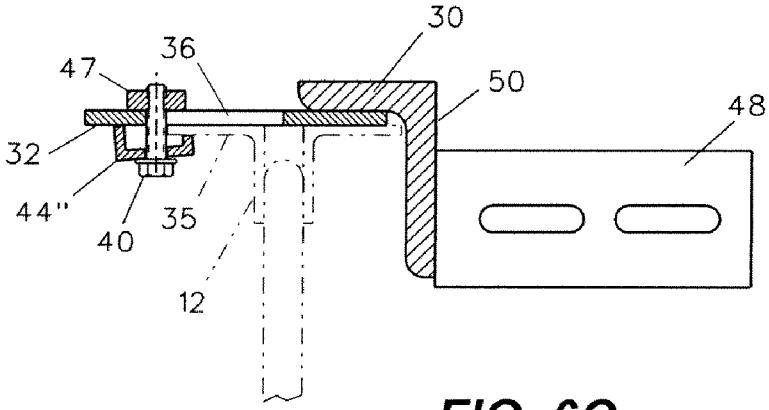
FIG. 6C is a cross-section view, taken along lines 6C-6C of FIG. 6B.

FIGS. 6A-C show the clamp 26 of the third embodiment (i.e. the clamp shown in FIG. 3C) in combination with a retainer heel clip 44", which includes a first heel 54 similar to the retainer heel clip 44' and a second heel 56 opposite the first heel 54. The second heel 56 includes first and second steps 58. The top portion of the second heel 56 bounded by the first and second extended guide tabs 58 defines a seat 60. The first and second extended guide tabs 58 are spaced to accommodate clamp plate 32 on the seat 60, such that the first and second extended guide tabs 58 capture the clamp plate 32 therebetween. The first and second extended guide tabs 58 contact respective sides of the clamp plate 32 when the clamp plate 32 is received on the seat 60, thereby preventing the retainer heel clip 44" from rotating relative to the clamp plate 32 during or after securement to a top flange 35 of a metal bar joist 12 (shown in broken lines in FIG. 6C).

Figure 7:
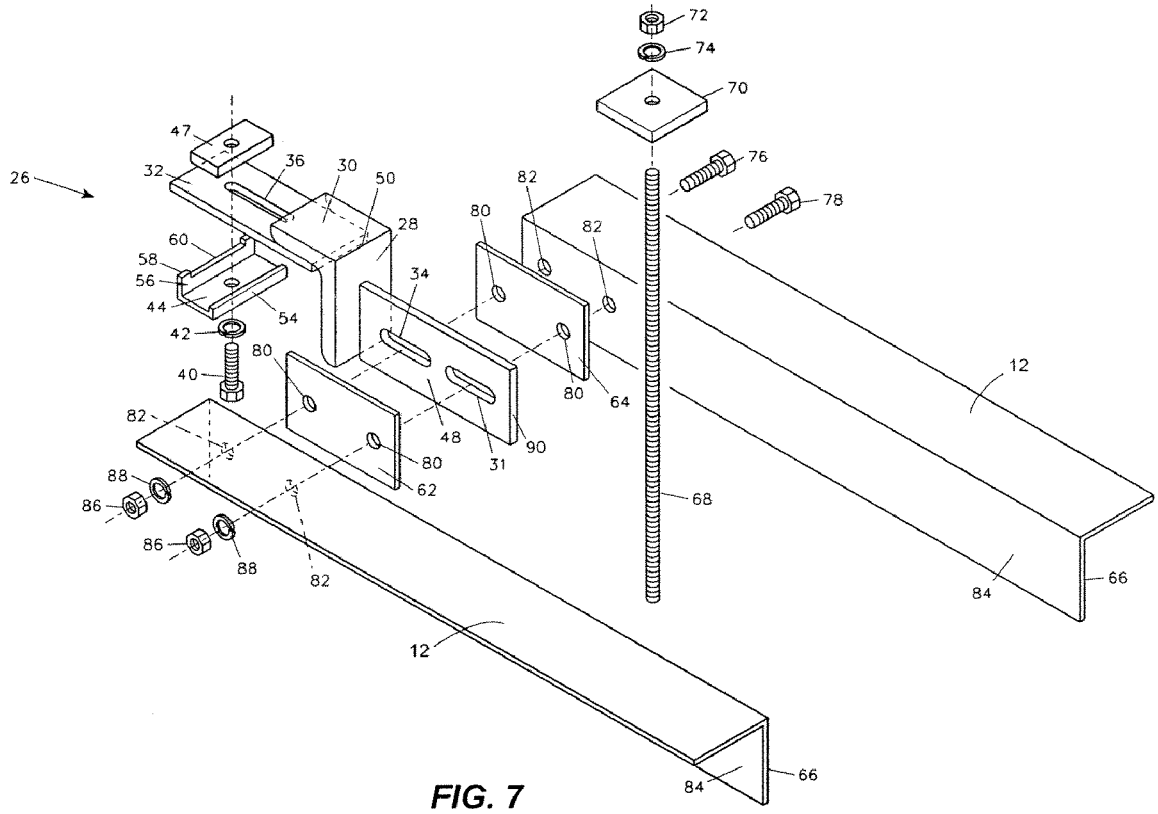
FIG. 7 is a perspective, exploded view of the clamp of the third embodiment in combination with the alternate retainer heel clip of FIG. 6A, a pair of spacer plates, and a pair of support angles, for supporting an object from a rod suspended between the pair of support angles.

FIG. 7 shows the clamp 26 of the third embodiment in combination with the retainer heel clip 44", a pair of spacer plates 62, 64 and a pair of support angles 66, for supporting an object from a rod 68 suspended between the pair of support angles 66. Another clamp 26 (not shown) and pair of spacer plates 62, 64 (also not shown) are provided at an opposite end of the pair of support angles 66. All or at least a portion of the rod 68 may be threaded to facilitates securement of the rod 68 to a plate 70, such as by a threaded nut 72 and a washer 74. The support angles 66 are secured to the vertical attachment tongue 48 of the clamp 26 and the spacer plates 62, 64 by bolts 76, 78 received in bolt-receiving apertures 80 of the spacer plates 62, 64, through the tongue apertures, i.e. the elongate slots 31, 34, and through mounting apertures 82 in the vertical portions 84 of the support angles 66. The bolts 76, 78 are secured in place by, for example, nuts 86 and washers 88.

The spacer plates 62, 64 are provided on at least one side of the vertical attachment tongue 48, if necessary, to provide a channel or space between the two support angles 66 wide enough to accommodate the rod 68. The plate 70 may be positioned at any location above that space to suspend the rod 68 within that space, such as between the end 90 of the vertical attachment tongue 48 farthest from the vertical component 45 of the associated bracket member 28, and a similar end 90 (not shown) of a vertical attachment tongue 48 (not shown) of the other clamp 26 (not shown) at the opposite end of the pair of support angles 66.

The configuration shown in FIG. 7 provides installers with great flexibility in hanging objects, such as lighting fixtures, signage, ceiling fans, and the like at desired locations between metal bar joists 12 or other structural beams in a roof support structure without having to drill or weld the actual structural joists 12 or beams. Thus, there is a significant savings in time and effort. Furthermore, the toll of such drilling or welding on the integrity of the roof support structure, which may be difficult or impossible to predict or ascertain, is avoided altogether. The resulting supported rod 68 is also easy to move to a different desired location within the channel between the support angles 66, and the entire assembly is easily relocated, by virtue of the easily installed clamps 26. This provides great modularity, which is desirable in, for instance, structures where adaptable floorplans or easily-convertible aisle layouts are desired.

While various embodiments of clamps for use with bar joists have been described herein, it is recognized that this disclosure is not limited to these embodiments. Variations may be made thereto which are still within the scope of the appended claims.

The invention claimed is:

1. A clamp for use in securing reinforcement members to bar joists underlying corrugated roof material, comprising:

at least one clamp plate insertable into a downwardly-open channel of a section of corrugated roof material, said at least one clamp plate including at least one aperture therethrough;

a vertical attachment tongue projecting perpendicularly to an end of each of the at least one clamp plates, said vertical attachment tongue including at least one tongue aperture therethrough, said tongue aperture having a central axis perpendicular to a central axis of the at least one aperture through each of the at least one clamp plate;

an angled bracket member having a horizontal component affixed to the end of each of the at least one clamp plate, the horizontal component extending parallel to the clamp plate and overlying the end of the clamp plate, and a vertical component extending downward from the horizontal component; and a retainer heel clip having a bolt-receiving aperture therethrough, said bolt-receiving aperture being alignable with the at least one aperture through the clamp plate, said retainer heel clip and said clamp plate adapted to securely receive a top flange of a bar joist therebetween.

2. The clamp of claim 1, further comprising a clamp backing plate intermediate the vertical component of the angled bracket member and the vertical attachment tongue.

3. The clamp of claim 1, wherein the aperture through each of the at least one clamp plates is an elongate slot.

4. The clamp of claim 1, wherein each of the at least one tongue apertures is an elongate slot.

5. The clamp of claim 1, including a threaded plate provided above the clamp plate, said threaded plate including a threaded opening alignable with the at least one aperture in the clamp plate and the bolt-receiving aperture of the retainer heel clip.

6. The clamp of claim 1, wherein the retainer heel clip includes a heel to accommodate a lipped flange of a bar joist.

7. A clamp for use in securing reinforcement members to bar joists comprising;

at least one clamp plate having a first end, a second end, and at least one aperture therethrough;

at least one generally L-shaped angled bracket member having a horizontal component affixed to the second end of one of the at least one clamp plates, the horizontal component extending parallel to the clamp plate and overlying the second end of the clamp plate, and a vertical component extending downward from an end of the horizontal component opposite the second end of the clamp plate;

a vertical attachment tongue projecting perpendicularly to the vertical component of the angled bracket member, said vertical attachment tongue having at least one tongue aperture therethrough; and at least one retainer heel clip having a bolt-receiving aperture therethrough, said bolt-receiving aperture of each of the at least one retainer heel clips being alignable with one of the apertures of the clamp plate, each of said at least one retainer heel clip and said at least one clamp plate adapted to securely receive a top flange of a bar joist therebetween.

8. The clamp of claim 7, wherein each of the at least one apertures of each of the at least one clamp plates is an elongate slot.

9. The clamp of claim 7, wherein each of the tongue apertures is an elongate slot.

10. The clamp of claim 7, further comprising a clamp backing plate intermediate the vertical component of each of the at least one generally L-shaped angled bracket members and the vertical attachment tongue.

11. The clamp of claim 10, including a threaded plate provided above the clamp plate, said threaded plate including a threaded opening alignable with the at least one aperture in the clamp plate and the bolt-receiving aperture of the retainer heel clip.

12. The clamp of claim 10, wherein the retainer includes a heel to accommodate a lipped flange of a bar joist.

13. A pair of clamps in combination with a framing angle, for securing the framing angle to bar joists underlying corrugated roof material, wherein:

each of said clamps comprises:

at least one clamp plate insertable into a downwardly-open channel of a section of corrugated roof material supported by a plurality of bar joists, said at least one clamp plate including at least one aperture therethrough;

a vertical attachment tongue projecting perpendicularly to an end of each of the at least one clamp plates, said vertical attachment tongue including at least one tongue aperture therethrough, each of said at least one tongue aperture having a central axis perpendicular to a central axis of the at least one aperture of the clamp plate a generally L-shaped angled bracket member having a horizontal component affixed to the end of each of the at least one clamp plate, the horizontal component extending parallel to the clamp plate and overlying the end of the clamp plate, and a vertical component extending downward from the horizontal component, and at least one retainer heel clip having a bolt-receiving aperture therethrough, said bolt-receiving aperture of each of the at least one retainer heel clips being alignable with one of the apertures of the clamp plate;

said framing angle having a plurality of perforations along its length, at least one of said perforations being alignable with the at least one tongue apertures of the vertical attachment tongue of a first clamp of the pair of clamps, and at least one other of said perforations being alignable with the at least one tongue apertures of the vertical attachment tongue of a second clamp of the pair of clamps.

14. The pair of clamps and framing angle combination of claim 13, wherein each of the clamps further comprises:

a clamp backing plate intermediate the vertical component of each of the at least one generally L-shaped angled bracket members and the vertical attachment tongue.

15. The pair of clamps and framing angle combination of claim 13, wherein each of the at least one apertures of the at least one clamp plates of each of the clamps is an elongate slot.

16. The pair of clamps and framing angle combination of claim 13, wherein each of the tongue apertures of the tongue of each of the clamps is an elongate slot.

17. The pair of clamps and framing angle combination of claim 13, wherein at least one of the clamps includes:

two clamp plates, each of said clamp plates being insertable into a distinct downwardly-open channel of a section of corrugated roof material supported by a plurality of bar joists, a pair of generally L-shaped angled bracket members, each having a horizontal component affixed to the second end of a respective one of the clamp plates and a vertical component extending downward from the horizontal component; and a clamp backing plate affixed to the vertical components of the generally L-shaped angled bracket members, said clamp backing plate connecting the generally L-shaped angled bracket members, and being disposed intermediate the vertical component of each of the generally L-shaped angled bracket members and the vertical attachment tongue.

18. The pair of clamps and framing angle combination of claim 13, including a threaded plate provided above each of the clamp plates, each of said threaded plates including a threaded opening alignable with the at least one aperture in the respective clamp plate and the bolt-receiving aperture of the respective retainer heel clip.

19. The pair of clamps and framing angle combination of claim 13, wherein the retainer heel clip includes a first heel and a second heel, at least one of the first and second heels including a first extended guide tab and a second extended guide tab at a top thereof.

20. The pair of clamps and framing angle combination of claim 19, wherein said first and second extended guide tabs are spaced from one another a distance greater than a width of the clamp plate.

21. The pair of clamps and framing angle combination of claim 19, wherein a seat is defined by the top of the at least one of the first and second heels between the first and second extended guide tabs, the clamp plate being received on said seat and the extended guide tabs contacting respective sides of the clamp plate, thereby preventing rotation of the retainer relative to the clamp plate.

22. The pair of clamps and framing angle combination of claim 13, wherein the framing angle is a first support angle, and in further combination with a second support angle secured between the pair of clamps, and a rod suspended from the first and second support angles.

23. The pair of clamps and support angles combination of claim 22, further comprising at least one spacer plate intermediate the vertical attachment tongue of one of the clamps and one of the support angles.

24. The pair of clamps and support angles combination of claim 22, further comprising, on either side of the vertical attachment tongue of each of the clamps, a spacer plate intermediate the vertical attachment tongue and a vertical component of the respective support angle.

25. The pair of clamps and support angles combination of claim 24, wherein the rod is received in a channel defined between a vertical component of each of the support angles and a distal end of the vertical attachment tongue of each of the clamps.

26. The pair of clamps and support angles combination of claim 25, wherein the rod is movable along the channel.

27. The pair of clamps and support angles combination of claim 22, wherein the rod is mounted to a plate provided on the support angles.

* * * * *